US011313163B2

(12) United States Patent
Yun et al.

(10) Patent No.: US 11,313,163 B2
(45) Date of Patent: Apr. 26, 2022

(54) LINK TYPE STRUCTURE FOR PREVENTING OPPOSITE SLIDING DOORS FROM SWAYING

(71) Applicants: Hyundai Motor Company, Seoul (KR); Kia Motors Corporation, Seoul (KR); Pyeong Hwa Automotive Co., Ltd., Daegu (KR)

(72) Inventors: Hyung-In Yun, Seoul (KR); Seong-Tae Hong, Daegu (KR); Ji-Hak Yoo, Daegu (KR)

(73) Assignees: Hyundai Motor Company, Seoul (KR); Kia Motors Corporation, Seoul (KR); Pyeong Hwa Automotive Co., Ltd., Daegu (KR)

( * ) Notice: Subject to any disclaimer, the term of this patent is extended or adjusted under 35 U.S.C. 154(b) by 255 days.

(21) Appl. No.: 16/825,631

(22) Filed: Mar. 20, 2020

(65) Prior Publication Data

US 2021/0172227 A1 Jun. 10, 2021

(30) Foreign Application Priority Data

Dec. 10, 2019 (KR) ..... 10-2019-0163399

(51) Int. Cl.
*E05D 15/30* (2006.01)
*E05D 15/06* (2006.01)
*E05D 15/10* (2006.01)

(52) U.S. Cl.
CPC ..... *E05D 15/30* (2013.01); *E05D 15/066* (2013.01); *E05D 15/0665* (2013.01); *E05D 15/101* (2013.01); *E05Y 2900/531* (2013.01)

(58) Field of Classification Search
CPC ... E05D 15/1081; E05D 15/101; E05D 15/30; E05D 15/066; E05D 15/0665; B60J 5/06
See application file for complete search history.

(56) References Cited

U.S. PATENT DOCUMENTS 6,328,374 B1 * 12/2001 Patel ..... B60J 5/06 296/155
7,611,190 B1 * 11/2009 Elliott ..... B60J 5/06 296/146.12
7,654,608 B2 * 2/2010 Krajenke ..... E05D 15/101 296/155
8,336,949 B2 * 12/2012 Boettcher ..... E05D 15/1047 296/155

(Continued)

FOREIGN PATENT DOCUMENTS

KR 101684536 B1 12/2016

*Primary Examiner* — Justin B Rephann
(74) *Attorney, Agent, or Firm* — Slater Matsil, LLP

(57) ABSTRACT

A link type structure includes a lower rail mounted in a longitudinal direction at a lower side of a vehicle body, a lower rail roller unit rollably connected to the lower rail, a lower rail swing arm rotatably connected to the lower rail roller unit and a door, a first link member having a first end rotatably connected to the door and a second end connected to a link hinge, a second link member having a first end rotatably connected to the lower rail roller unit and a second end connected to the link hinge, and a spring provided on the link hinge. The spring is configured to supply elastic force such that one end of the first link member applies force to the door in a direction toward outside of the vehicle body.

20 Claims, 8 Drawing Sheets

(56) References Cited

U.S. PATENT DOCUMENTS

| | | | | |
|---|---|---|---|---|
| 8,353,555 | B2 * | 1/2013 | Boettcher | E05D 15/1047 296/155 |
| 9,701,183 | B2 * | 7/2017 | Choi | B60J 5/06 |
| 2011/0126466 | A1 * | 6/2011 | Adachi | E05F 15/646 49/262 |
| 2015/0291014 | A1 * | 10/2015 | Choi | B60J 5/06 49/449 |
| 2016/0123060 | A1 * | 5/2016 | Choi | E05C 19/02 49/254 |
| 2016/0129769 | A1 * | 5/2016 | Choi | E05C 3/124 49/120 |
| 2016/0130844 | A1 * | 5/2016 | Choi | E05D 15/1081 49/449 |
| 2016/0201375 | A1 * | 7/2016 | Seto | E05D 15/1042 49/360 |
| 2016/0298372 | A1 * | 10/2016 | Seto | B60J 5/12 |
| 2016/0356069 | A1 | 12/2016 | Choi et al. | |
| 2018/0119465 | A1 * | 5/2018 | Wojdyla | E05D 13/04 |

* cited by examiner

LINK TYPE STRUCTURE FOR PREVENTING OPPOSITE SLIDING DOORS FROM SWAYING

CROSS-REFERENCE TO RELATED APPLICATIONS

This application claims priority to Korean Patent Application No. 10-2019-0163399, filed in the Korean Intellectual Property Office on Dec. 10, 2019, which application is hereby incorporated herein by reference.

TECHNICAL FIELD

The present invention relates to a link type structure for preventing opposite sliding doors from swaying.

BACKGROUND

In general, a vehicle has an occupant compartment having a predetermined size in which a driver or an accompanied occupant may be seated, and occupant compartment opening/closing doors are installed on a vehicle body to open or close the occupant compartment.

Sliding type occupant compartment opening/closing doors include a front sliding door installed at a front side in a longitudinal direction of a vehicle and a rear sliding door installed at a rear side in the longitudinal direction of the vehicle. The front sliding door and the rear sliding door are typically installed to be moved along rails mounted on a vehicle body or the doors.

However, the sliding type occupant compartment opening/closing door in the related art requires three rails (an upper rail, a center rail, and a lower rail) that support an upper portion, a middle portion, and a lower portion of the door during the process of opening or closing the door, and the sliding type occupant compartment opening/closing door also requires components related to the rails. For this reason, the sliding type occupant compartment opening/closing door in the related art has a problem in that the weight of the vehicle and the number of components are increased and a degree of design freedom of the vehicle deteriorates.

Therefore, there has been developed a two-rail type door system for a vehicle in which a sliding door is slidably supported only with center and lower rails. For example, Korean Patent No. 10-1684536 (Sliding Door System for Vehicle) in the related art discloses that a door rail (i.e., a center rail) is mounted on a sliding door, a vehicle body rail (i.e., a lower rail) is mounted on a vehicle body, and the sliding door is opened or closed as a center slider coupled to the door rail and a lower slider coupled to the vehicle body rail are moved.

However, referring to FIGS. 1 and 2, in the sliding structure in the related art, as support points at which the sliding door is supported, two support points including a contact point A between the vehicle body rail and the lower slider and a contact point B between the center rail and the center slider are formed in a vertical direction. However, there is a problem in that the sliding door rotates about an imaginary axis X connecting the contact points. In addition, because the support points for the sliding door are formed only on the imaginary axis X, there remains only one contact point A in a load direction (direction of the imaginary axis X) when a load of the sliding door is applied, and as a result, the sliding door cannot be stably supported.

SUMMARY

The present invention relates to a link type structure for preventing opposite sliding doors from swaying. Particular embodiments relate to a link type structure for preventing opposite sliding doors from swaying, the link type structure being capable of preventing the sway of the sliding door by means of supporting force generated by motions of two link members while the sliding door is opened or closed in a vehicle mounted with the sliding door and having only center and lower rails.

The present invention has been made in an effort to provide a new type of structure capable of preventing sway of a sliding door and supporting a load while the sliding door is opened or closed in a vehicle mounted with the sliding door and having only center and lower rails.

An exemplary embodiment of the present invention provides a link type structure for preventing opposite sliding doors from swaying, the link type structure including a lower rail mounted in a longitudinal direction at a lower side of a vehicle body, a lower rail roller unit rollably connected to the lower rail, a lower rail swing arm rotatably connected to the lower rail roller unit and the door, a first link member having one end rotatably connected to the door and the other end connected to a link hinge, and a second link member having one end rotatably connected to the lower rail roller unit and the other end connected to the link hinge. Here, a spring for applying elastic force is provided on the link hinge so that one end of the first link member applies force to the door in a direction toward the outside of the vehicle body.

According to embodiments of the present invention, since supporting force for supporting the door is generated by the operations of the two link members, the door is prevented from swaying in the width direction (L direction) of the vehicle body.

According to embodiments of the present invention, in the state in which the door is completely opened, it is possible to ensure a space between the two link members and a side outer member formed at the lower side of the vehicle body.

According to embodiments of the present invention, since the two link members have the first and second rigidity supplement members formed in the height direction (H direction) of the vehicle body, the two link members are prevented from being damaged by a load applied to the door.

DETAILED DESCRIPTION OF ILLUSTRATIVE EMBODIMENTS

Hereinafter, a link type structure for preventing opposite sliding doors from swaying according to embodiments of the present invention will be described in detail with reference to the drawings. Terms or words used herein should not be interpreted as being limited to a general or dictionary meaning and should be interpreted as a meaning and a concept which conform to the technical spirit of the present invention based on a principle that an inventor can appropriately define a concept of a term in order to describe his/her own invention by the best method.

Figure 1:
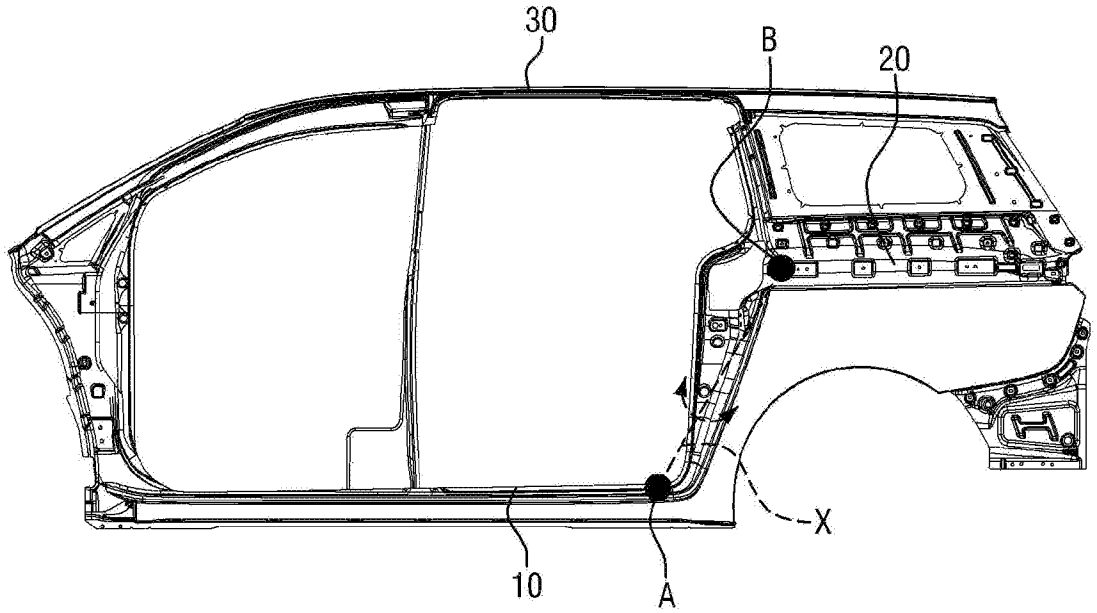
FIG. 1 is a view illustrating support points at which a sliding door for a vehicle having only center and lower rails in the related art is supported.
Figure 2:
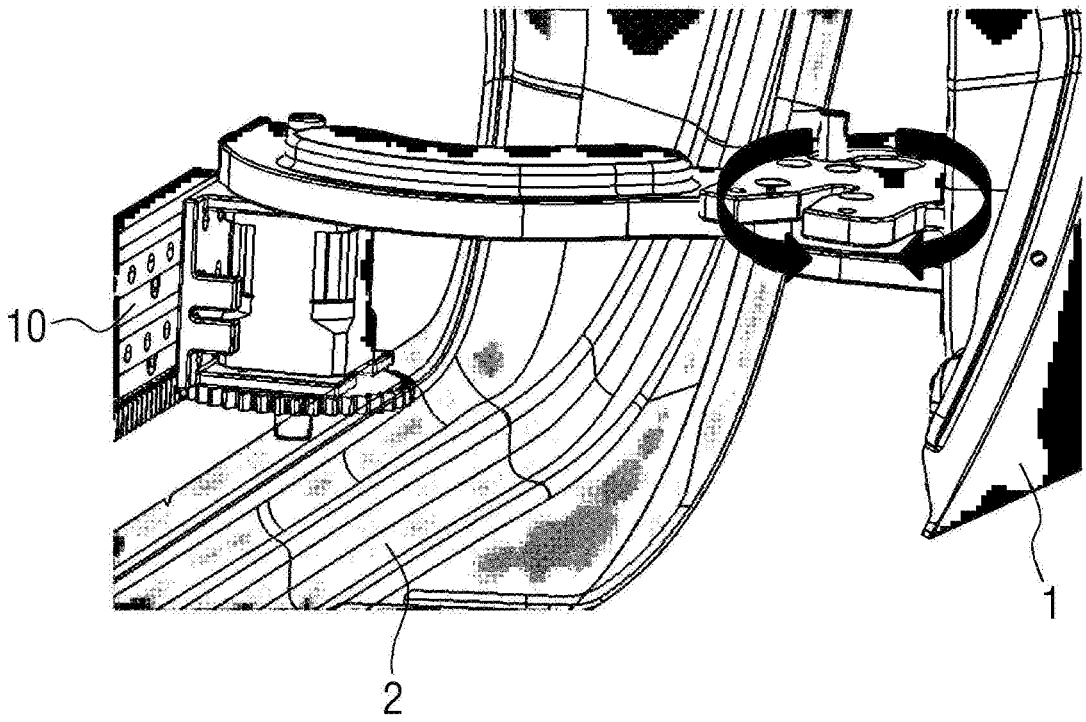
FIG. 2 is a view illustrating a state in which the sliding door illustrated in FIG. 1 is rotatable.
Figure 3:
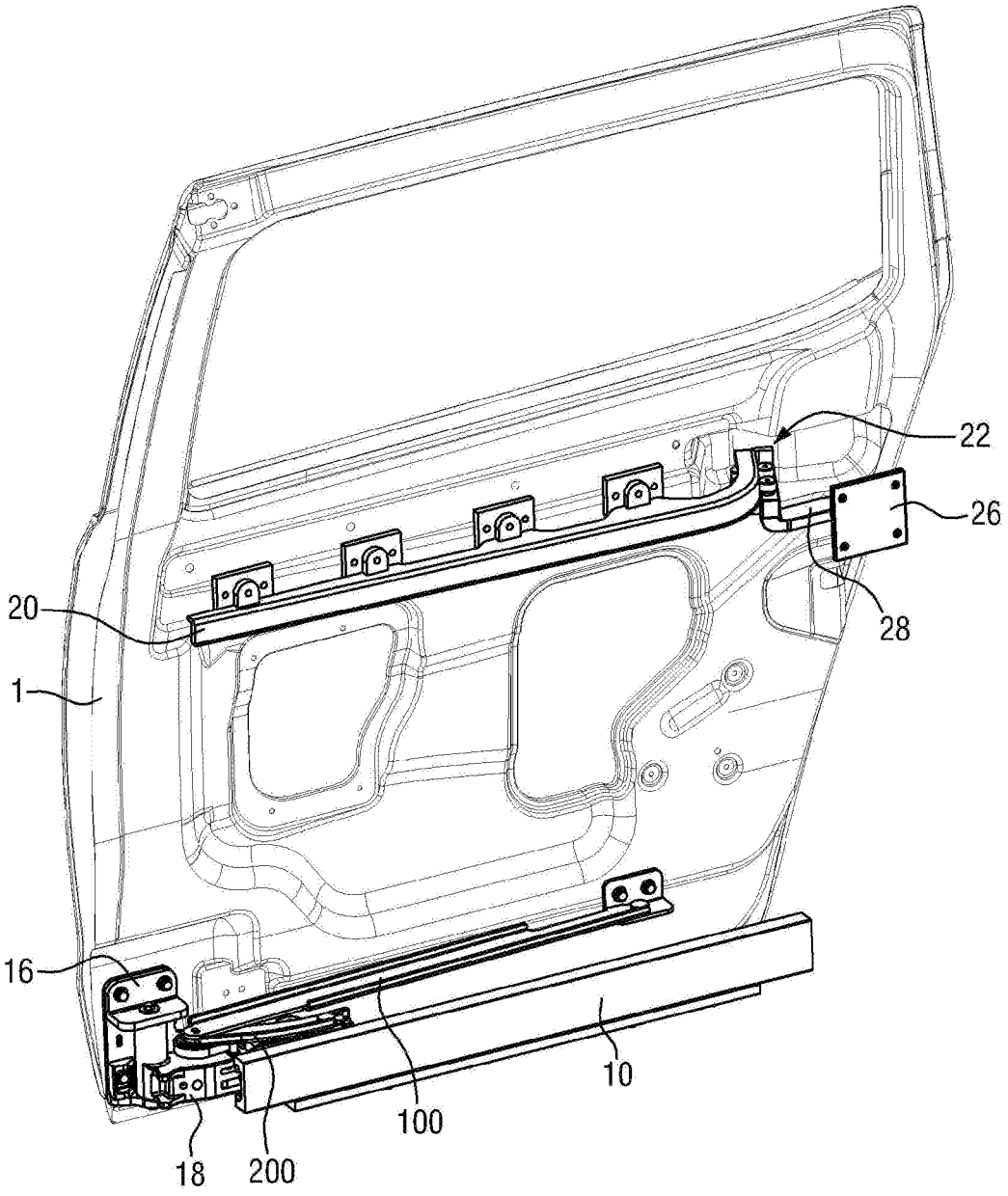
FIG. 3 is a view illustrating a state in which a link type sway prevention structure according to an exemplary embodiment of the present invention is mounted on a sliding door.
Figure 4:
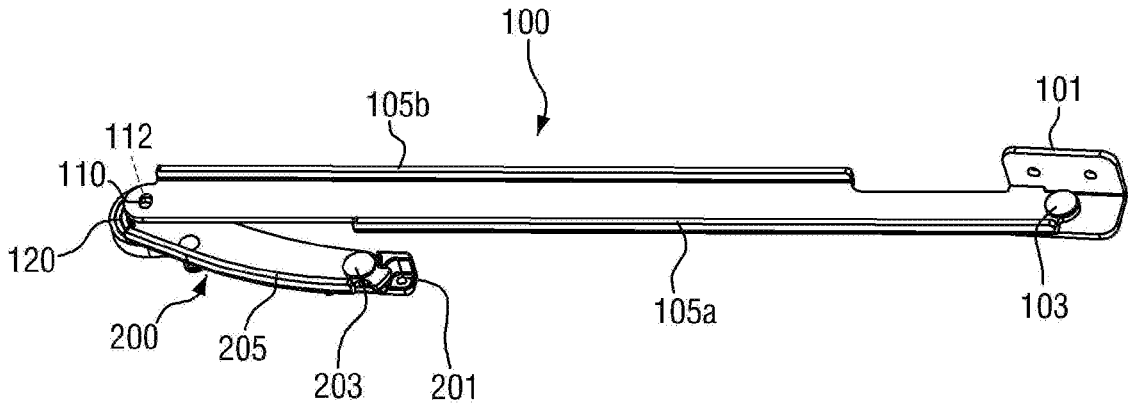
FIG. 4 is a view illustrating a link type sway prevention structure according to an exemplary embodiment of the present invention when viewed from above.
Figure 5:
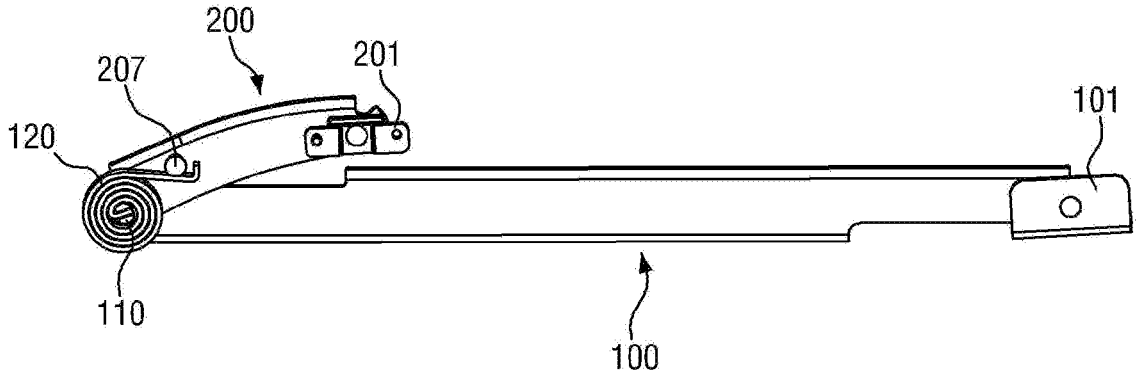
FIG. 5 is a view illustrating a link type sway prevention structure according to an exemplary embodiment of the present invention when viewed from below.

FIG. 3 is a view illustrating a state in which a link type sway prevention structure according to an exemplary embodiment of the present invention is mounted on a sliding door, FIG. 4 is a view illustrating a link type sway prevention structure according to an exemplary embodiment of the present invention when viewed from above, and FIG. 5 is a view illustrating a link type sway prevention structure according to an exemplary embodiment of the present invention when viewed from below.

According to an exemplary embodiment of the present invention, in a vehicle, there are only a lower rail 10 (a rail disposed at a lower side of the vehicle) and a center rail 20 (a rail disposed at a center of the vehicle), but there is no upper rail 30 (a rail disposed at an upper side of the vehicle). Here, the lower rail 10 is provided on a vehicle body 2, and the center rail 20 is provided on a sliding door 1.

The sliding doors 1 include a front door and a rear door, and the link type structure for preventing opposite sliding doors from swaying according to an exemplary embodiment of the present invention is applied to the lower rail 10 of the front door or the rear door. Therefore, the link type structures for preventing opposite sliding doors from swaying, which are applied to the front door and the rear door, respectively, are identical in configuration and operational principle. However, in the present specification, for ease of description, an example in which the link type structure for preventing opposite sliding doors from swaying is applied to any one of the sliding doors 1 will be described.

For ease of description, a configuration of the vehicle body 2 is omitted from FIG. 3.

Referring to FIG. 3, the link type structure for preventing opposite sliding doors from swaying according to an exemplary embodiment of the present invention is provided at the lower sides of the vehicle body 2 and the door 1 and includes the lower rail 10, a lower rail roller unit 12, a lower rail swing arm 18, a first link member 100, and a second link member 200.

One end of the lower rail roller unit 12 is inserted into the lower rail 10 provided in a longitudinal direction of the vehicle body 2, such that the lower rail roller unit 12 is rollably coupled to the lower rail 10. Specifically, the lower rail roller unit 12 includes a slider 14, and rollers 15 provided on the slider 14 are inserted into the lower rail 10 and rollably coupled to the lower rail 10 (see FIG. 7). The lower rail roller unit 12 may move in the longitudinal direction of the vehicle body 2 while being guided by the lower rail 10.

One end of the lower rail swing arm 18 is rotatably connected to a lower swing arm mounting bracket 16 fixedly mounted inside the door 1, and the other end of the lower rail swing arm 18 is rotatably connected to the lower rail roller unit 12. Therefore, when the door 1 moves, the lower rail swing arm 18 may rotate about the lower rail roller unit 12 and may rectilinearly move along the lower rail 10.

Meanwhile, as described above, in an exemplary embodiment of the present invention, the center rail 20 is fixed to the door 1. A center rail roller unit 22 is rollably connected to the center rail 20. The center rail roller unit 22 is rotatably connected to a center swing arm mounting bracket 26 fixedly connected to the vehicle body 2 through a center rail swing arm 28.

The first link member 100 is a member configured to support the door 1 and elongated in the longitudinal direction of the vehicle body 2, as illustrated in FIG. 4. One end of the first link member 100 is rotatably connected to the door 1. Specifically, a first guide bracket 101 is fixedly connected to the door 1, and one end of the first guide bracket 101 and one end of the first link member 100 are connected with a first guide pin 103. Therefore, the first link member 100 may rotate about the first guide pin 103. The other end of the first link member 100 is connected to a link hinge 110. In an exemplary embodiment of the present invention, since the other end of the first link member 100 is fixed to the link hinge 110, the link hinge 110 may move together with the first link member 100 when the first link member 100 moves.

A spring 120 is provided on the link hinge 110. The spring 120 according to an exemplary embodiment of the present invention is a spiral spring formed in a direction in which the spiral spring surrounds the link hinge 110. The spiral spring is a spring that entirely has a coil shape and operates such that when a first end of the two ends is fixed and a second end is rotated in one direction, torque is generated in the other direction at the first end. Referring to FIG. 5, one end of the spring 120 according to an exemplary embodiment of the present invention is fixed to the link hinge 110.

First rigidity supplement members 105*a* and 105*b* are provided at both sides of the first link member 100, and the first rigidity supplement members 105*a* and 105*b* are formed in a vertical direction (a height direction of the vehicle body 2) and in a longitudinal direction of the first link member 100. However, in an exemplary embodiment of the present invention, a part at one side of the first link member 100 is not provided with the first rigidity supplement member 105*a*. Here, the first rigidity supplement members 105*a* and 105*b* are auxiliary members that resist external force applied to the first link member 100 in the vertical direction.

The second link member 200 is a member connected to the first link member 100 to support the door 1. The second link member 200 has a length approximately similar to or smaller than a length of the lower rail swing arm 18. One end of the second link member 200 is rotatably connected to the lower rail roller unit 12. Specifically, a second guide bracket 201 is fixedly connected to one side of the lower rail roller unit 12, and the second guide bracket 201 and one end of the second link member 200 are connected with a second guide pin 203. Therefore, the second link member 200 may rotate about the second guide pin 203. The other end of the second link member 200 is rotatably connected to the link hinge 110. For example, a hole (not illustrated) is formed at the other end of the second link member 200 so that the link hinge 110 is inserted into the hole, and the hole may have a larger diameter than the link hinge 110.

As a result, the first link member 100 and the second link member 200 connect the door 1 and the vehicle body 2, and the first link member 100 and the second link member 200 are connected to be rotatable about a link rotation axis 112.

Meanwhile, the other end of the spring 120 is connected to a catching member 207 provided on the second link member 200. Referring to FIG. 5, in an exemplary embodiment of the present invention, the other end of the spring 120 is bent and caught by and connected to the catching member 207. However, the other end of the spring 120 and the second link member 200 may be connected in various manners.

A second rigidity supplement member 205 is provided at one side of the second link member 200, and the second rigidity supplement member 205 is formed in the vertical direction (the height direction of the vehicle body 2) and in a longitudinal direction of the second link member 200. No second rigidity supplement member 205 is provided at the other side of the second link member 200 because if the second rigidity supplement member 205 is provided at the other side of the second link member 200, the first and second rigidity supplement members 105*a* and 205 interfere with each other, which causes the rotations of the first and second link members 100 and 200 to be restricted when the first and second link members 100 and 200 rotate close to each other about the link hinge 110. Therefore, a part at one side of the first link member 100 is not provided with the first rigidity supplement member 105*a*. Similar to the first rigidity supplement members 105*a* and 105*b*, the second rigidity supplement member 205 is an auxiliary member that resists external force applied to the second link member 200 in the vertical direction.

Figure 6:
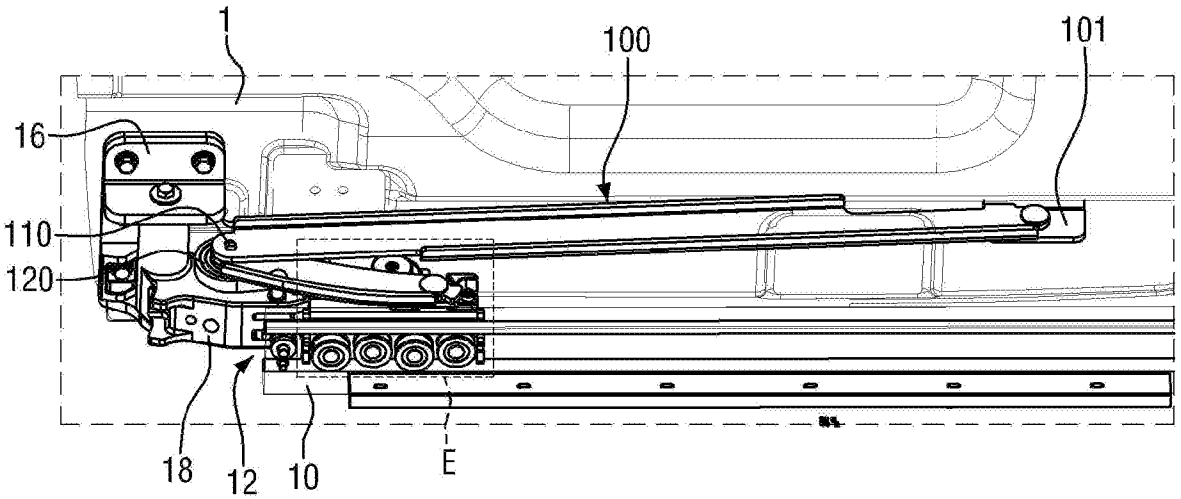
FIG. 6 is a view illustrating a link type sway prevention structure according to an exemplary embodiment of the present invention in a state in which the sliding door is closed.
Figure 7:
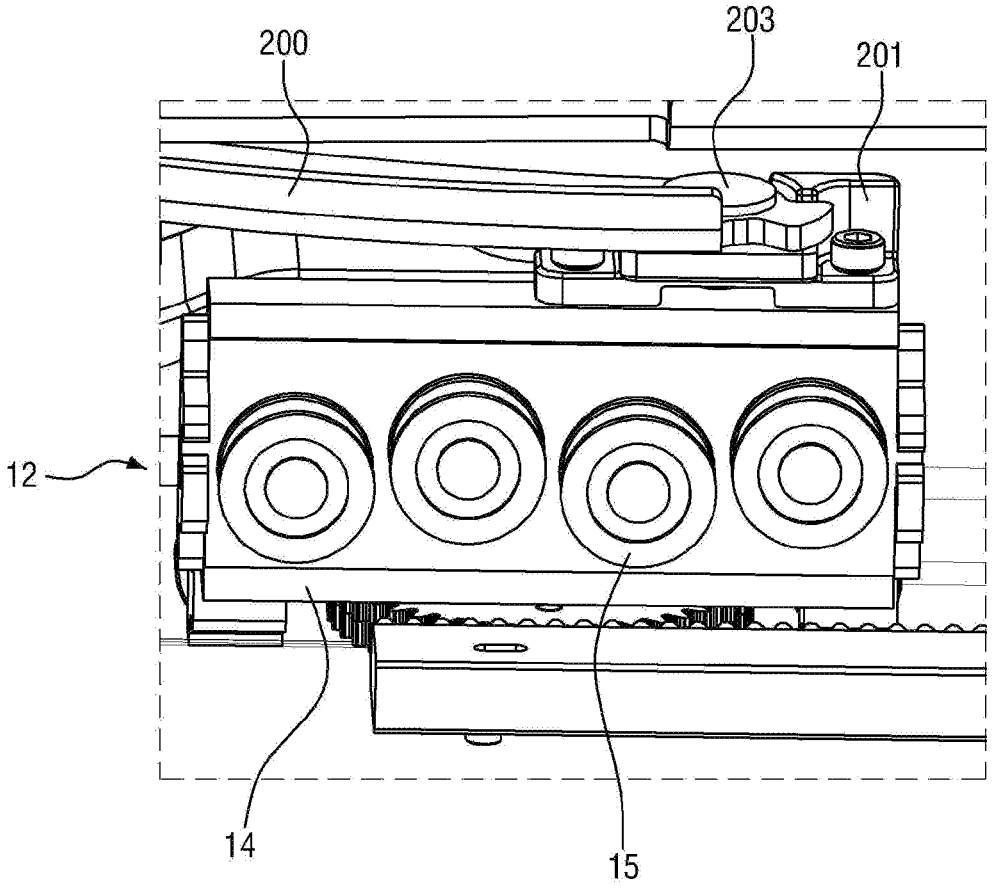
FIG. 7 is an enlarged view of part E in FIG. 6.
Figure 8:
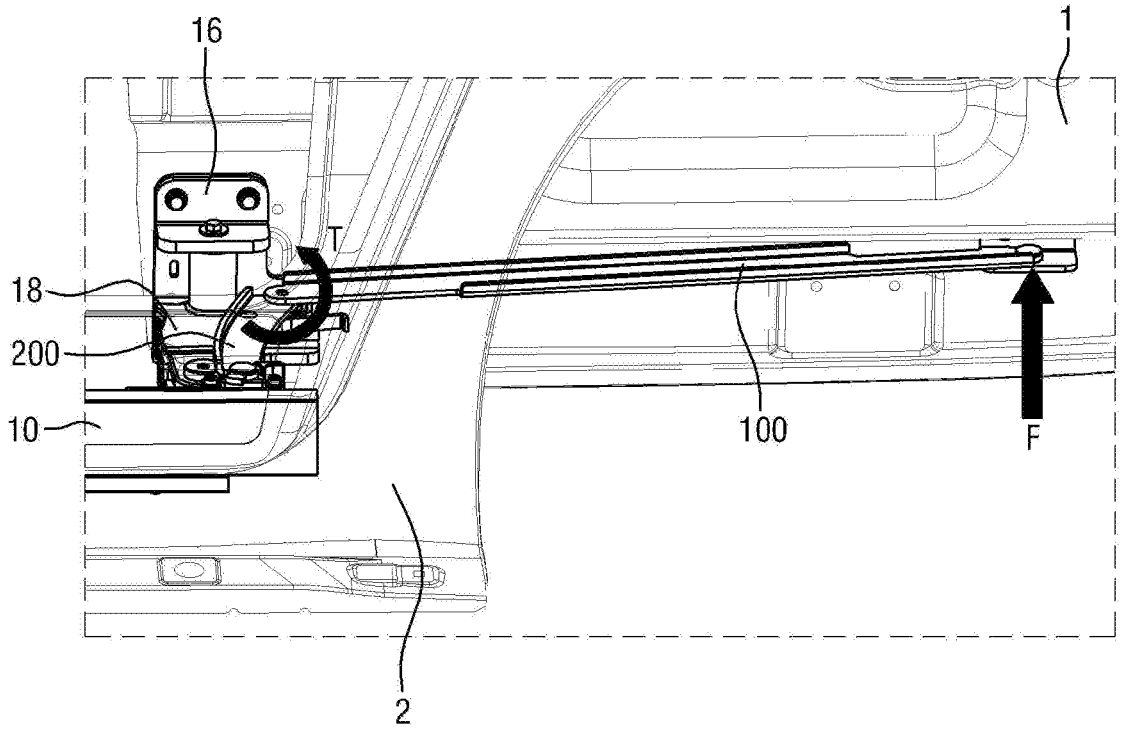
FIG. 8 is a view illustrating a link type sway prevention structure according to an exemplary embodiment of the present invention in a state in which the sliding door is opened.

FIG. 6 is a view illustrating a link type sway prevention structure according to an exemplary embodiment of the present invention in a state in which the sliding door is closed, FIG. 7 is an enlarged view of part E in FIG. 6, and FIG. 8 is a view illustrating a link type sway prevention structure according to an exemplary embodiment of the present invention in a state in which the sliding door is opened.

Hereinafter, an operating process of the link type sway prevention structure according to an exemplary embodiment of the present invention will be described with reference to FIGS. 6 to 8.

The first link member 100 is elongated in the longitudinal direction of the vehicle body 2. One end of the first link member 100 is rotatably connected to the door 1 by means of the first guide bracket 101, and the other end of the first link member 100 is connected to the link hinge 110. One end of the second link member 200 is rotatably connected to one side of the slider 14 by means of the second guide bracket 201, and the other end of the second link member 200 is connected to the link hinge 110. Therefore, the first and second link members 100 and 200, together with the lower rail swing arm 18, may move along with the lower rail roller unit 12.

FIG. 6 illustrates the state in which the door 1 is closed, the lower rail roller unit 12 is positioned at one end of the lower rail 10 (the left side in FIG. 6), and the lower rail swing arm 18 is completely rotated in one direction based on the door 1. In this case, the link hinge 110 is positioned at one side of the lower rail swing arm 18. FIG. 6 illustrates the state in which at one side of the lower rail swing arm 18, the second link member 200 connected to the link hinge 110 is rotated in the same direction as the lower rail swing arm 18.

When the door 1 begins to be opened, the lower rail roller unit 12 begins to move toward the other side of the lower rail 10 (the right side in FIG. 6), and the lower rail swing arm 18 begins to rotate in the other direction (clockwise) based on the door 1. In this case, the second link member 200, together with the lower rail swing arm 18, begins to rotate in the other direction (clockwise). Since the other end of the spring 120 is caught by the second link member 200, torque T for a rotation in one direction (a counterclockwise rotation) is generated at one end of the spring 120 fixed to the link hinge 110. The torque T is transmitted to one end of the first link member 100 and rotates the first guide bracket 101 about the first guide pin 103 in a direction toward the outside of the vehicle body 2. That is, force F, which is applied in the direction toward the outside of the vehicle body 2, is applied to the first guide bracket 101 while the door 1 is opened, and the force F is supporting force for supporting the door 1.

The operating processes of the first and second link members 100 and 200 continue until the door 1 is completely opened. Referring to FIG. 8, when the second link member 200 rotates in the other direction (clockwise) based on the door 1, torque is generated in one direction (counterclockwise) by the spring 120. In this case, force F is generated in the direction toward the outside of the vehicle body 2 by the first link member 100.

A process reverse to the above-mentioned process is performed while the opened door 1 is closed. Even in this case, force F is generated in the direction toward the outside of the vehicle body 2 by the torque T generated by the spring 120.

Therefore, according to an exemplary embodiment of the present invention, the supporting force for supporting the door 1 is generated by the operations of the first and second link members 100 and 200. The supporting force continues to be generated while the door 1 moves.

According to an exemplary embodiment of the present invention, in the state in which the door 1 is completely opened, it is possible to ensure a space between the first and second link members 100 and 200 and a side outer member (not illustrated) formed at the lower side of the vehicle body 2.

Figure 9:
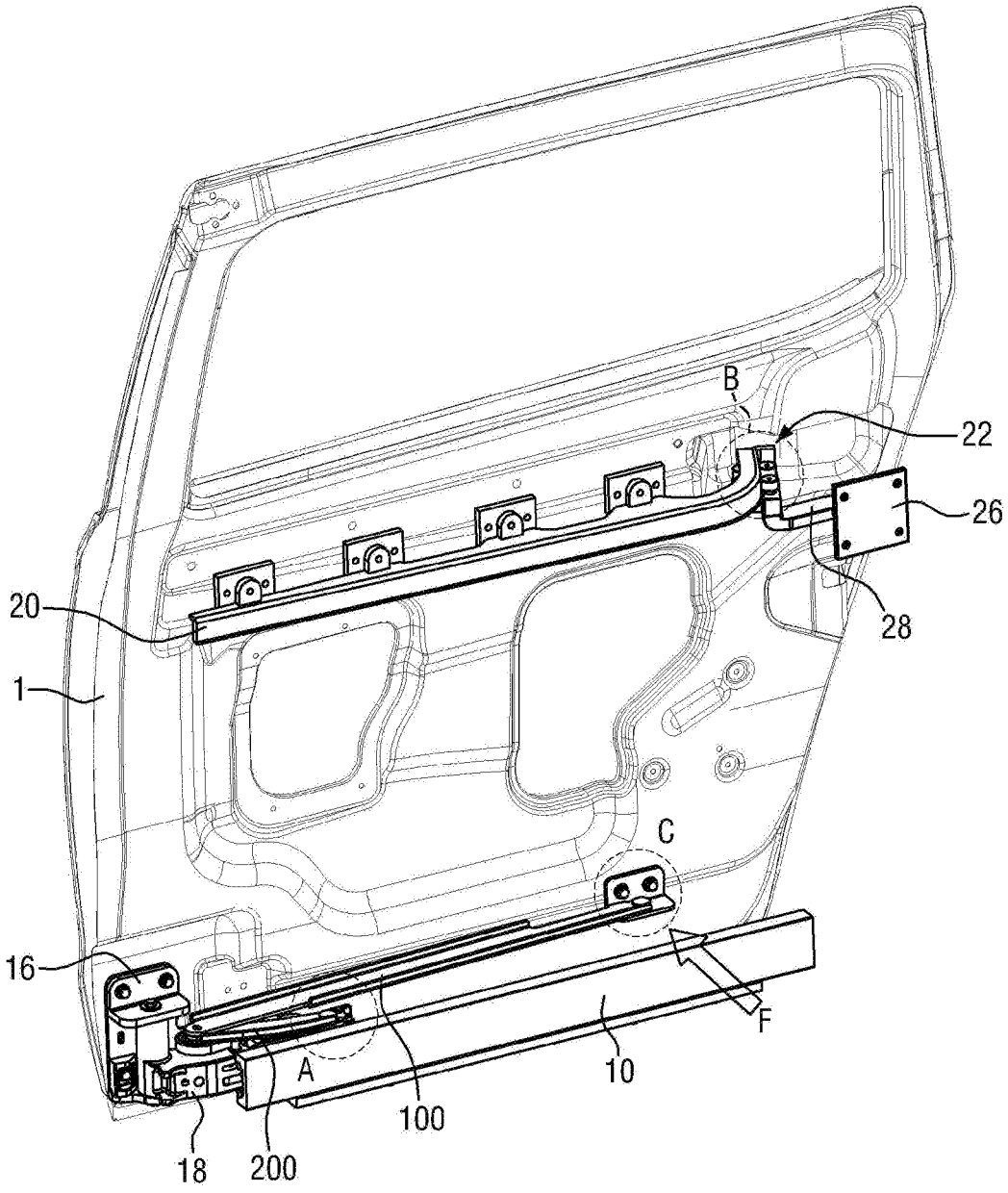
FIG. 9 is a view illustrating three support points at which the sliding door is supported by means of a link type sway prevention structure according to an exemplary embodiment of the present invention.

FIG. 9 is a view illustrating three support points at which the sliding door is supported by means of a link type sway prevention structure according to an exemplary embodiment of the present invention.

In the related art, in the vehicle having only the center rail 20 and the lower rail 10, the door 1 is supported at two support points A and B. For this reason, when the door 1 moves, the door 1 is eccentrically tilted by its own weight and sways in the width direction (L direction) of the vehicle body 2, and thus the door 1 cannot be stably supported.

Referring to FIG. 9, according to an exemplary embodiment of the present invention, there are three support points at which the door 1 is supported, and the three support points include a contact point A between the lower rail 10 and the lower rail roller unit 12, a contact point B between the center rail 20 and the center rail roller unit 22, and a connection point C between one end of the first link member 100 and the door 1. The three support points A, B, and C define an approximately triangular shape. Because the three support points are continuously maintained while the door 1 moves, the door 1 is stably supported, and the door 1 is prevented from swaying in the L direction.

Since the first and second rigidity supplement members 105*a*, 105*b*, and 205 provided on the first and second link members 100 and 200 are formed in the height direction (H direction) of the vehicle body 2, the first and second link members 100 and 200 are prevented from being damaged by a load applied to the door 1.

The present invention has been described with reference to exemplary embodiments and the drawings, but the present invention is not limited thereto. The described exemplary embodiments may be variously changed or modified by those skilled in the art to which the present invention pertains within the technical spirit of the present invention and within the scope equivalent to the appended claims.

What is claimed is:

1. A link type structure comprising:

a lower rail mounted in a longitudinal direction at a lower side of a vehicle body;

a lower rail roller unit rollably connected to the lower rail;

a lower rail swing arm rotatably connected to the lower rail roller unit and a door;

a first link member having a first end rotatably connected to the door and a second end connected to a link hinge;

a second link member having a first end rotatably connected to the lower rail roller unit and a second end connected to the link hinge; and a spring provided on the link hinge, wherein the spring is configured to supply elastic force such that one end of the first link member applies force to the door in a direction toward outside of the vehicle body.

2. The link type structure of claim 1, wherein the spring is a spiral spring having a shape surrounding the link hinge in order to generate torque.

3. The link type structure of claim 2, wherein a first end of the spiral spring is connected to the link hinge and a second end of the spiral spring is connected to the second link member.

4. The link type structure of claim 3, wherein the first link member is fixed to the link hinge and is configured to receive rotational force from the link hinge.

5. The link type structure of claim 1, wherein the second end of the first link member is positioned at one side of the lower rail swing arm.

6. The link type structure of claim 1, wherein the first link member is elongated in the longitudinal direction of the vehicle body.

7. The link type structure of claim 1, wherein the door has a first guide bracket to which one end of the first link member is rotatably connected.

8. The link type structure of claim 1, wherein the first link member or the second link member includes a rigidity supplement member formed in a height direction of the vehicle body.

9. The link type structure of claim 1, wherein the lower rail roller unit has a second guide bracket to which one end of the second link member is rotatably connected.

10. The link type structure of claim 1, further comprising:

a center rail formed at a middle portion of the door; and a center rail roller unit connected to the center rail, wherein the door is supported at three support points, and the support points comprise a first contact point between the lower rail and the lower rail roller unit, a second contact point between the center rail and the center rail roller unit, and a connection point between one end of the first link member and the door.

11. A vehicle comprising:

a vehicle body;

a sliding door; and a link type structure comprising:

a lower rail mounted in a longitudinal direction at a lower side of the vehicle body;

a lower rail roller unit rollably connected to the lower rail;

a lower rail swing arm rotatably connected to the lower rail roller unit and the sliding door;

a first link member having a first end rotatably connected to the sliding door and a second end connected to a link hinge;

a second link member having a first end rotatably connected to the lower rail roller unit and a second end connected to the link hinge; and a spring provided on the link hinge, wherein the spring is configured to supply elastic force such that one end of the first link member applies force to the sliding door in a direction toward outside of the vehicle body.

12. The vehicle of claim 11, wherein the spring is a spiral spring having a shape surrounding the link hinge in order to generate torque.

13. The vehicle of claim 12, wherein a first end of the spiral spring is connected to the link hinge and a second end of the spiral spring is connected to the second link member.

14. The vehicle of claim 13, wherein the first link member is fixed to the link hinge and is configured to receive rotational force from the link hinge.

15. The vehicle of claim 11, wherein the second end of the first link member is positioned at one side of the lower rail swing arm.

16. The vehicle of claim 11, wherein the first link member is elongated in the longitudinal direction of the vehicle body.

17. The vehicle of claim 11, wherein the sliding door has a first guide bracket to which one end of the first link member is rotatably connected.

18. The vehicle of claim 11, wherein the first link member or the second link member includes a rigidity supplement member formed in a height direction of the vehicle body.

19. The vehicle of claim 11, wherein the lower rail roller unit has a second guide bracket to which one end of the second link member is rotatably connected.

20. The vehicle of claim 11, further comprising:

a center rail formed at a middle portion of the sliding door; and a center rail roller unit connected to the center rail, wherein the sliding door is supported at three support points, and the support points comprise a first contact point between the lower rail and the lower rail roller unit, a second contact point between the center rail and the center rail roller unit, and a connection point between one end of the first link member.

* * * * *